US005853336A

United States Patent [19]

Hufgard

[11] Patent Number: 5,853,336

[45] Date of Patent: Dec. 29, 1998

[54] GOLFING AID

[76] Inventor: John W. Hufgard, 381 Hickory Hill, Chagrin Falls, Ohio 44022

[21] Appl. No.: 828,792

[22] Filed: Mar. 27, 1997

[51] Int. Cl.[6] ..... A63B 55/10; A63B 57/00

[52] U.S. Cl. ..... 473/282; 473/285; 473/286; 473/406; 473/408; 248/166; 248/174

[58] Field of Search ..... 473/282, 285, 473/286, 406, 408; 248/166, 174

[56] References Cited

U.S. PATENT DOCUMENTS

| | | | |
|---|---|---|---|
| D. 357,964 | 5/1995 | Williams . | |
| D. 365,133 | 12/1995 | Belmont . | |
| 548,875 | 10/1895 | Heimann | 248/166 |
| 2,284,242 | 5/1942 | Ziemmerman | 273/285 |
| 2,400,241 | 5/1946 | Linden . | |
| 2,642,305 | 6/1953 | Butlet . | |
| 2,898,110 | 8/1959 | Overbaugh | 473/388 |
| 3,263,820 | 8/1966 | McFadden | 211/60.1 |
| 4,007,928 | 2/1977 | Doubt . | |
| 4,822,052 | 4/1989 | Dimmick | 473/285 |
| 4,834,328 | 5/1989 | Hall | 248/37.3 |
| 5,010,669 | 4/1991 | Moran | 40/539 |
| 5,012,832 | 5/1991 | Turner | 135/87 |
| 5,152,524 | 10/1992 | Brown | 473/285 |
| 5,226,647 | 7/1993 | Notarmuzi . | |
| 5,249,827 | 10/1993 | Olson | 283/36 |
| 5,292,120 | 3/1994 | Pehoski et al. . | |
| 5,314,079 | 5/1994 | Young | 211/70.2 |
| 5,529,299 | 6/1996 | Bellagamba . | |
| 5,704,847 | 1/1998 | Glennon | 473/282 |

FOREIGN PATENT DOCUMENTS

| | | |
|---|---|---|
| 496938 | 4/1930 | Germany . |

*Primary Examiner*—Sebastiano Passaniti
*Assistant Examiner*—Stephen L. Blau
*Attorney, Agent, or Firm*—Gerstman, Ellis & McMillin, Ltd.

[57] ABSTRACT

A golf club handle support for keeping handles of golf clubs lying on the ground in a raised position above the ground. The handle support comprises a stiff sheet defining a central foldline to form sidewalls on each side of the foldline. This permits the sheet to assume a substantially inverted V-shape in cross section so that the remote edges parallel to the foldline may engage the ground and a golf club may rest on the sidewalls at or adjacent to the foldline.

19 Claims, 1 Drawing Sheet

GOLFING AID

BACKGROUND OF THE INVENTION

While golfers usually carry a bag in a golf cart or with a caddy, periodically a golfer will find himself a few steps away from the bag, carrying a pair of clubs such as a putter and a pitching wedge. For this or for other reasons the golfer may wish to lay the club down in the grass, which of course is undesirable when the grass is wet since the club handle should not get wet. Likewise, clubs can be mislaid in taller grass if laid down.

Also, conscientious golfers will repair their divots on the putting green, and this is best done with a small tool.

Likewise, circumstances arise when the golfer marks his ball and removes it, for example in the situation where someone else is putting.

By this invention, a simple, foldable sheet can address all of these issues, while being conveniently stored without taking significant space in a pocket or the golf bag.

DESCRIPTION OF THE INVENTION

By this invention, support for an item such as a golf club is provided for keeping their handles lying on the ground in a raised position above the ground, visible and free from wet grass. Such a handle support comprises a stiff sheet defining a central foldline and defining sidewalls of a sheet on each side of the foldline, plus parallel sidewall edges remote from the foldline. This permits the sheet to be folded to assume substantially an inverted V-shape in cross section. Thus, the parallel sidewall edges which are spaced from the foldline may engage the ground, and a golf club may rest on the sidewalls at the foldline, so that the handle is held above the ground in visible manner and so as not to be wetted by the grass.

Preferably, the parallel sidewall edges remote from the foldline are serrated so as to slightly penetrate the ground and to provide stable gripping so that the stiff sheet does not collapse out of its inverted V configuration. However at other times, the stiff sheet may be unfolded if desired, or completely folded together so that the sidewalls are parallel and abutting to each other, providing a storage configuration for the stiff sheet in which practically no space is taken up.

It is further preferable for at least one and preferably both of the sidewalls to define a sidewall extension that crosses and interrupts the foldline. Each of such extensions are spaced from the other extension along the foldline, to define a golf club-receiving space between the respective extensions. Each extension defines a slit edge periphery except along the axis of the foldline, whereby each extension remains essentially parallel with its sidewall which is positioned across the foldline, when the sheet is folded in the inverted V-shape. Thus, the respective sidewall extensions form projections in such an inverted V-shape which cause the handle support of this invention to be rather of an X-shaped configuration in cross-section as viewed from an end thereof. Such a cross section of course includes the basic inverted V-shaped cross section.

At least one of these extensions may comprise an outwardly projecting free end, in the inverted V-shape of the stiff sheet, that comprises a pair of spaced, parallel fingers. Such a structure can serve as a divot repair tool. The other of the extensions may be shaped in the same or some other shape as may be desired.

Also, the sheet may define at least one portion which is surrounded by a closed-loop line of tearing weakness, to provide a removable ball marker. Alternatively, a separate ball marker may be removably and replaceably attached to the sheet. For example, the ball marker may comprise a flat member having a transversely extending rod that is frictionally retained in an aperture defined in the stiff sheet.

The stiff sheet used herein may be conventionally made of any appropriate material, such as plastic, cardboard, or composite of the two. For example, the sheet may comprise a plastic reinforced cardboard sheet, or it may comprise a polyolefin sheet, typically of polyethylene, polypropylene, or a mixture or copolymer of the two.

DESCRIPTION OF THE DRAWINGS

Referring to the drawings.

DESCRIPTION OF SPECIFIC EMBODIMENTS

Figure 1:
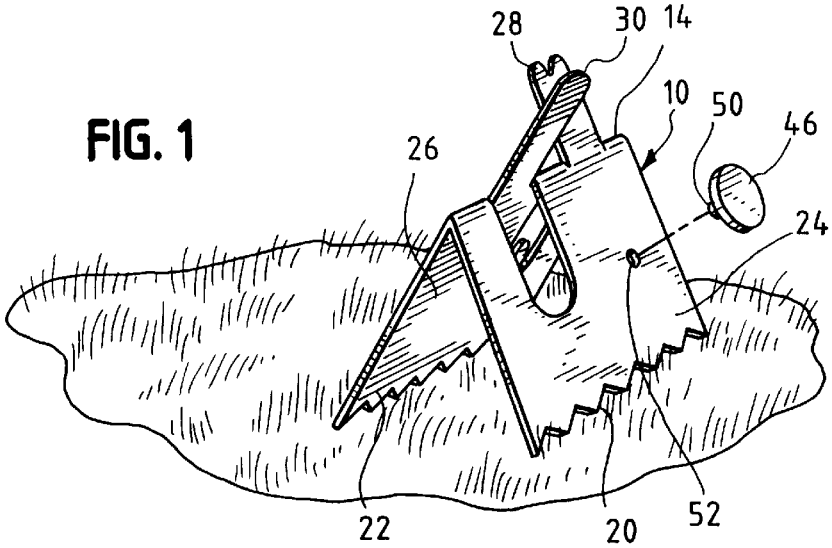
FIG. 1 is a perspective view of a golf club handle support of this invention.
Figure 2:
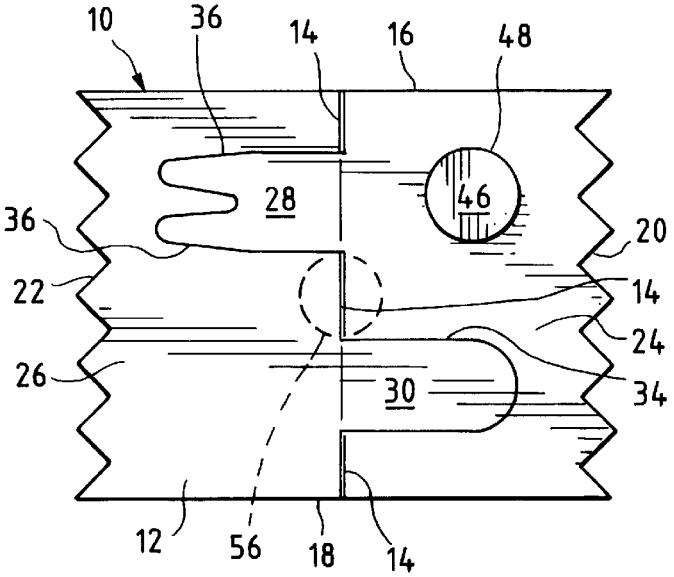
FIG. 2 is a plan view of the golf club handle support of this invention, shown in flat configuration.
Figure 3:
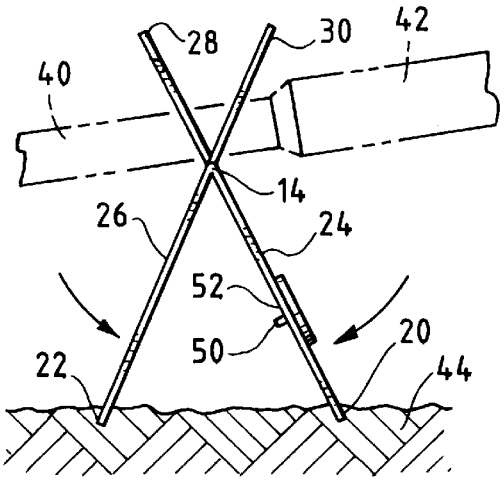
FIG. 3 is a side elevational view of the handle support of FIG. 2, folded into inverted, V-shaped configuration and shown to be supporting the handle of a golf club.
Figure 4:
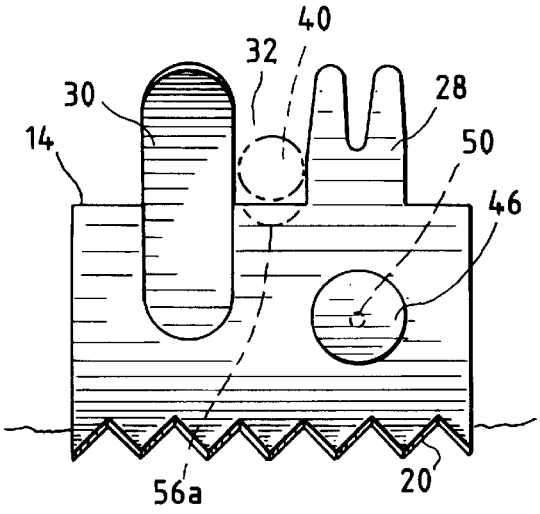
FIG. 4 is a front elevational view of the golf club handle support in the configuration of FIG. 3.

Referring to the drawings, golf club handle support 10 comprises a stiff sheet 12, shown in flat configuration in FIG. 2, and shown in FIGS. 1, 3, and 4 to be folded along intermittent foldline 14 which extends between respective lateral edges 16, 18 of the sheet. Thus sheet 12 can be folded into the inverted-V configuration shown particularly in FIG. 3, with serrated, opposed edges 20, 22 shown to be pressing against the ground 44.

Stiff sheet 12 also defines the respective sidewalls 24, 26, positioned on opposite sides of foldline 14, each of the sidewalls defining a serrated edge 20, 22, each of edges 20, 22 being substantially parallel to foldline 14.

Each of sidewalls 24, 26 are shown to define a sidewall extension or tab 28, 30 which extends from its respective, connected sidewall across the axis of foldline 14. Foldline 14 is typically not present between each respective extension or tab 28, 30 and its sidewall 24, 26. Specifically, sidewall 24 is connected without a foldline to tab 28, and sidewall 26 is connected without a foldline to tab 30. The various sections of foldline 14 then are positioned beside and between the respective tabs 28, 30. It can be seen that tabs 28, 30 are laterally spaced from each other along foldline 14 to provide a golf club handle receiving space 32 between the two tabs 28, 30.

Each of the extensions or tabs 28, 30 respectively defines a slit edge 34, 36 (or a thin line of tearing weakness which is substantially equivalent to a slit edge) along their peripheries except at the areas of the axis of foldline 14 where the respective extensions or tabs 28, 30 connect with their respective sidewalls 24, 26. Thus, as particularly shown in FIGS. 1, 3, and 4, when the stiff sheet 12 is folded along foldline 14 to form the inverted V configuration as shown in FIG. 2, the respective extensions or tabs 28, 30 continue to lie in coplanar relation with their connected sidewall 24, 26, and separate from the other sidewall, due to slit peripheries 34, 36 which permit such separation. Hence, while sidewalls 24, 26 assume an inverted V configuration, sidewall extensions or tabs 28, 30 project outwardly to provide an X-shaped configuration as seen from the end as particularly shown in FIG. 3, although of course extensions 28, 30 do not extend along the entire length of foldline 14 as sidewalls 24, 26 typically do.

A golf club 40 may be laid in the space 32 between the respective extensions 28, 30, being firmly retained there with the handle 42 of the club kept in visible, elevated position out of the grass 44, which may be wet. Thus club 40 can be put down without placing it in the bag and without getting the handle wet or otherwise dirty. Handle support 10 of this invention is unlikely to slip on the ground because of the serrated edges 20, 22 which engage the ground, providing firm support.

At the same time, divots on the green or elsewhere may be replaced with the assistance of particularly projection 28, which serves as a divot replacement tool, although projection 30 may also be used in similar manner.

Furthermore, a ball marker disk 46 may be provided. If desired, disk 46 may be an integral part of sheet 12, surrounded by a closed loop line of tearing weakness at the edge 48 of disk 46 so that disk 46 may be torn out of stiff sheet 12 and used. However, as shown particularly FIGS. 1, 3, and 4, ball marker disk 46 may define an outwardly projecting pin 50 which frictionally and tightly fits in aperture 52 of one of the sidewalls, specifically sidewall 24. Such a ball marker disk may be removed, used, and then replaced in tight aperture 52 for convenient and safe storage of the marker disk 46.

If desired, an optional, central cutout 56 may be provided for further securance of a golf club handle. This optional cutout, when folded, forms an optional recess 56*a* to more securely hold the handle when it is present.

Thus, a versatile aid to golfing is provided, being made substantially of a single, stiff sheet with a foldline, being capable of facilitating the temporary storage of golf clubs, the replacement of divots and ball marking, while comprising a device that takes essentially no space and is extremely inexpensive. Stiff sheet 12 may be about 3×4 inches in size, being foldable in half to be even smaller in a storage configuration. If made of polyolefin plastic such as polyethylene, the thicker, relatively stiff sidewalls 24, 26 may be separated by plastic living hinge sections 14, which are highly durable and quite flexible, to provide a golfing aid that is long lasting, waterproof, and cheap. Also, golf data, advertising, and/or promotional information may be printed on it.

The above has been offered for illustrative purposes only, and is not intended to limit the scope of the invention of this application, which is as defined in the claims below.

That which is claimed:

1. A golf club handle support and a golf club lying on the ground and having a handle resting on said support in a raised position above the ground, which handle support comprises:

a stiff sheet defining a central foldline to define a sidewall on each side of the foldline and sidewall edges generally parallel to and remote from said foldline, to permit said sheets to assume substantially an inverted V-shape in cross section, said parallel sidewall edges engaging the ground, and said golf club handle resting on the sidewalls at or adjacent said foldline, in which said stiff sheet defines at least one portion surrounded by a closed-loop line of tearing weakness to provide a removable ball marker.

2. The golf club handle support of claim 1 in which said parallel sidewall edges are serrated.

3. The golf club handle support of claim 1 in which at least one of said sidewalls defines a sidewall extension that crosses and interrupts said foldline.

4. The golf club handle support of claim 3 in which each of said sidewalls define one of said sidewall extensions, each of said extensions being spaced from the other extension, to define a golf club receiving space between the respective extensions, each extension defining a slit edge periphery except adjacent the axis of said foldline, whereby each extension remains essentially parallel with its sidewall positioned across said foldline when said sheet is folded in said inverted V-shape.

5. The golf club handle support of claim 4 in which at least one of said extensions comprises an outwardly projecting free end, in said inverted V-shape, that comprises a pair of spaced, parallel fingers serving as a divot repair tool.

6. The golf club handle support of claim 1 in which said sheet is made of polyolefin.

7. The golf club handle support of claim 1 in which a ball marker is removably and replaceably attached to said sheet.

8. The golf club handle support of claim 7 in which said ball marker comprises a flat member having a transversely extending rod that is frictionally retained in an aperture defined in said sheet.

9. The golf club handle support of claim 1 in which said sheet defines a central cutout portion along said foldline.

10. A golf club handle support for keeping handles of golf clubs lying on the ground in a raised position above the ground, which, handle support comprises:

a stiff sheet defining a central foldline to define sidewalls on each side of the foldline and parallel sidewall edges remote from said foldline, said parallel edges being serrated, to permit said sheet to assume substantially an inverted V-shape in cross-section, at least one of said sidewalls defining a sidewall extension that crosses and interrupts said foldline, the extension defining a slit edge periphery except along the axis of said foldline, whereby the extension remains essentially parallel with its sidewall positioned across said foldline when said sheet is folded into said inverted V-shape.

11. The golf club handle support of claim 10 in which each of said sidewalls defines one of said extensions, the respective extensions being spaced from each other along said foldline to define a central golf club handle-receiving space.

12. The golf club handle support of claim 11 in which at least one of said extensions comprises an outwardly projecting free end, in said inverted V-shape, that comprises a pair of spaced, parallel fingers serving as a divot repair tool.

13. The golf club handle support of claim 12 in which a ball marker is removably and replaceably attached to said sheet.

14. The golf club handle support of claim 13 in which said flat ball marker comprises a flat member having a transversely extending rod that is frictionally retained in an aperture defined in said sheet.

15. The golf club handle support of claim 10 in which said sheet defines a central cutout portion along said foldline.

16. The golf club handle support of claim 10 in which said sheet is made of polyolefin.

17. A golf club handle support for keeping handles of golf clubs lying on the ground in a raised position above the ground, which handle support comprises:

a stiff sheet defining a central foldline to define a sidewall on each side of the foldline, and sidewall edges generally parallel to and remote from said foldline, to permit said sheets to assume substantially an inverted V-shape in cross section, whereby said parallel sidewall edges may engage the ground, and a golf club may rest on the sidewalls at or adjacent said foldline, at least one of said sidewalls defining a sidewall extension that crosses and interrupts said foldline.

18. The golf club handle support of claim 17 in which each of said sidewalls define one of said sidewall extensions, each of said extensions being spaced from the other extension, to define a golf club receiving space between the respective extensions, each extension defining a slit edge periphery except adjacent the axis of said foldline, whereby each extension remains essentially parallel with its sidewall positioned across said foldline when said sheet is folded in said inverted V-shape.

19. The golf club handle support of claim 18 in which said parallel sidewall edges are serrated.

* * * * *